US005701712A

United States Patent [19]

Andersen

[11] Patent Number: 5,701,712

[45] Date of Patent: Dec. 30, 1997

[54] DOUBLE-TOP GARMENT

[76] Inventor: Alfred Frederick Andersen, 467 River Rd., Eugene, Oreg. 97404

[21] Appl. No.: 457,139

[22] Filed: Jun. 1, 1995

[51] Int. Cl.[6] ..... A41B 1/00

[52] U.S. Cl. ..... 2/69; 2/DIG. 2; D7/741

[58] Field of Search ..... 2/90, 93, 102, 2/103, 105, 106, 113, 115, DIG. 2, 69; D2/741, 841, 844

[56] References Cited

U.S. PATENT DOCUMENTS 3,492,676 2/1970 King ..... 2/DIG. 2 X
5,019,355 5/1991 Shannon et al. ..... 2/69

*Primary Examiner*—C. D. Crowder
*Assistant Examiner*—Shirra L. Jenkins

[57] ABSTRACT

A garment having a first garment portion and a second garment portion attached at their bottom edges to form a single garment. While one of the garment portions is worn about the body, the other garment may be tucked into the lower body garment of the wearer as a spare garment.

1 Claim, 1 Drawing Sheet

DOUBLE-TOP GARMENT

BACKGROUND OF THE INVENTION

The Double-Top Garment is designed to provide two options for enclosing the neck and cover the shoulders and upper part of the human body. In contrast to other shirt-type, blouse-type, and cardigan-sweater-type garments, which have one top and one bottom, this garment has two tops and a middle. When one of its "tops" (with or without collar and with or without sleeves) is being worn around the shoulders and neck the mating "top" usually (such as when fastened down the front as distinct from down the back or one side) hangs around the lower back and the seat, normally tucked under the trousers and serving as a warming pad while standing and walking and a warming and comforting pad when sitting., though it may also hang freely outside the trousers.

One of the mating "tops" of a particular version of this garment could be of the "dress-shirt" variety, with the other "top" of a sporting design. Thus, a person could wear the dressy "top" to a formal affair, or at work, earlier in the day and, via a quick trip to a Rest Room, switch to the sporting "top" for a recreational or otherwise informal event. Many other combinations in mating "tops" would be possible, depending on whim or appropriateness for each of two quite different occasions scheduled to follow each other inaday.

To give another example, a family may be scheduled to first go on a family outing where the children are likely to get their "tops" soiled, followed by a party or some other dress-up occasion in which they will be expected to be neatly dressed. Parents who have outfitted them with versions of the Double-Top Garment could rest easy in realizing that any soiling of the initially worn "top" could easily be replaced by a fresh, clean one by simply reversing the garment, and thus bringing the clean end to the light of day while the soiled end is tucked inside the trousers—all without having to carry spares in a separate handbag. The ability to change "tops" would be especially helpful if one or more children are sent off on their own, because parents need not be concerned that a parcel carrying the change-of-clothing will be lost along the way—with the Double-Top Garment there is no separate parcel to get lost, and yet a change of "top" is always ready at hand.

A convenient feature of the Double-Top Garment is the fact that one need never be concerned about shirt tail sticking out. The "tail" of this garment will never stick out and will never leave the lower back exposed—it is too securely wrapped around the lower back and seat. Thus, this often-embarrassing experience is completely avoided. Therefore, those who have a problem with shirt tails sticking out and lower back exposure might favor this garment because of this feature alone.

Mention above was made of this garment's feature of providing warmth around the lower back and seat. This can provide considerable advantage in cold weather, especially when the outer protective garment is a short jacket rather than a coat. Thus it allows a person, especially a workman, to take advantage of the freedom-to-work of the short jacket without sacrificing warmth of the lower back and seat.

Mention was also made of the padding provided by this garment while seating. This can be especially comforting if the only seat available is a cold one, such as on an outside wall, or on the ground. But it can also be very comforting when the only seat available is a hard one or an uneven one. Yet, the lower "top" is so evenly spread out around the lower back and seat when it is not covering the neck and shoulders that it doesn't bunch up under the trousers, either to a discomfort extent or an extent visible to the eye by others.

When this garment is ready to be put in place around the shoulders and neck it is open, normally "down the front." (See below for other variations.) When in place, with one of its "tops" enfolding the lower back and seat, the two sides are ready to be connected by some means, such as by buttons, by snaps, by Velcro, by some other means, or by some combination of these. The fastening normally proceeds from the neck down until a point is reached when two goals have been achieved: (1) the fastening has taken place well beyond the part of the garment which will be visible when the trousers are in place; (2) the lower part of the garment is comfortably snug (normally around the lower back and seat) without being bunched at any point; (3) the sleeves (if any) in the lower part are in the "inside-out" position, so that they are not dangling in a way so as to interfere with pulling the trousers into place. When, in a matter of seconds, these three goals have been accomplished the trousers are ready to be pulled into place. In doing so, one would use the same care that would be used in the case of keeping in place long shirt-tails.

The material used to make this garment can be quite varied, from light to heavy cloth, from synthetic to natural, from woven to knitted. It can be designed for wear by women, by men, by boys, and by girls. The styles of the "tops" can vary as much as any clothing on the market today, and the contrast between the mating "tops" can be as great as human imagination.

Even though, as noted above, this garment is normally fastened down the front, it can also be fastened down the back, down the left side, the right side, or any place in between. When fastened down the back the lower part will wrap around the lower front of the body instead of the lower rear. When fastened on the left side, the lower part will wrap around the lower right side. And when fastened on the right side the lower half will wrap around the lower left side.

DETAILED DESCRIPTION OF DRAWINGS

Figure 1:
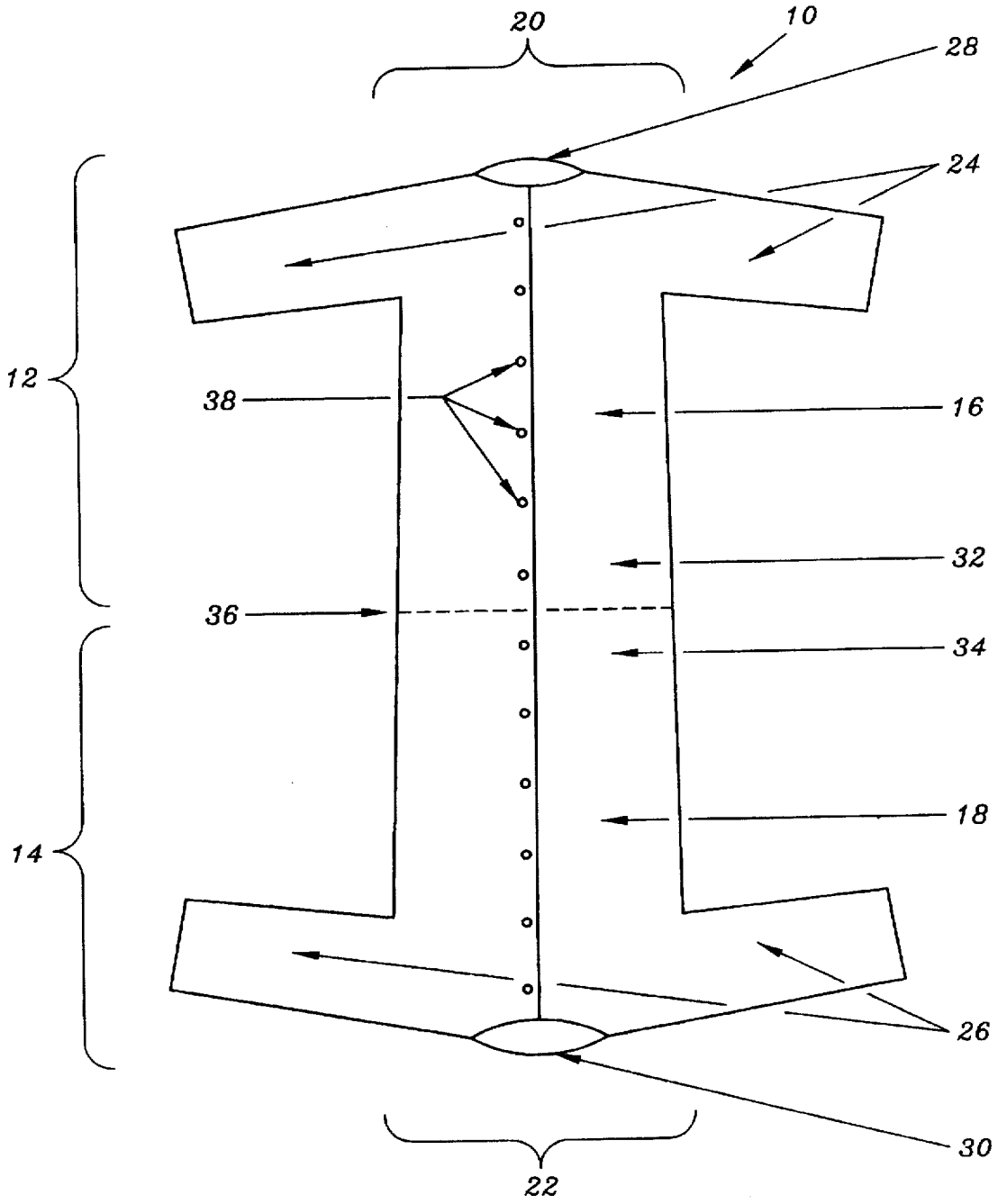
FIG. 1 is a perspective view of the invention including first and second garment portions.

Referring now to the drawings, a double-top garment 10 is shown having a first garment portion 12 and a second garment portion 14. The first garment portion 12 comprises a first body portion 16 for covering the torso of the wearer. At the upper end of the first body portion is a first shoulder region 20 having a first pair of sleeves 24 and a first neck opening 28. At the lower end of the first garment portion 12 is a first tail portion 32. The second garment portion 14 comprises a second body portion 18 which can also be used to cover the torso of the wearer. At the upper end of the second body portion is a second shoulder region 22 having a second pair of sleeves 26 and a second neck opening 30. At the lower end of the second garment portion 14 is a second tail portion 34.

The first garment portion 12 and the second garment portion 14 are permanently attached to each other along a bottom edge 36 of the first tail portion 32 and the second tail portion 34. A fastening means 38 extends from the first neck opening 28 to the second neck opening 30 which allows the wearer to put the garment on the body.

I claim:

1. A garment comprising a first garment portion and a second garment portion, the first garment portion comprising:

a first body portion for covering the upper section of a wearer's body;

a first shoulder region at one end of said first body portion and having a first pair of sleeves and a first neck opening;

a first tail portion at the other end of said first body portion;

and wherein the second garment portion comprises:

a second body portion for covering the upper section of a wearer's body;

a second shoulder region at one end of said second body portion and having a second pair of sleeves and a second neck opening;

a second tail portion at the other end of said second body portion;

wherein the first tail portion is permanently attached to the second tail portion such that the second garment portion forms a mirror image of the first garment portion and serves as an insulating pad or spare garment when tucked into a lower body garment of a wearer;

and fastening means for said garment extending from the first neck opening to the second neck opening.

* * * * *